US005120705A

United States Patent [19]

Davidson et al.

[11] Patent Number: 5,120,705

[45] Date of Patent: Jun. 9, 1992

[54] SUPERCONDUCTING TRANSMISSION LINE CABLE CONNECTOR PROVIDING CAPACATIVE AND THERMAL ISOLATION

[75] Inventors: Allen L. Davidson, Crystal Lake; Marc K. Chason, Schaumburg, both of Ill.

[73] Assignee: Motorola, Inc., Schaumburg, Ill.

[21] Appl. No.: 571,390

[22] Filed: Aug. 22, 1990

Related U.S. Application Data

[63] Continuation-in-part of Ser. No. 372,504, Jun. 28, 1989, abandoned.

[51] Int. Cl.[5] ..... H01P 1/04; H01B 12/12

[52] U.S. Cl. ..... 505/1; 505/704; 505/885; 505/886; 505/866; 333/24 C; 333/260; 333/99 S; 174/15.5; 174/15.6

[58] Field of Search ..... 333/99 S, 260, 24 C; 174/15.5, 15.6; 505/1, 703, 704, 866, 885, 886, 888, 898

[56] References Cited

U.S. PATENT DOCUMENTS

| | | | |
|---|---|---|---|
| 2,434,509 | 1/1948 | Okress | 333/260 |
| 3,263,193 | 7/1966 | Allen et al. | 333/99 S X |
| 3,309,632 | 3/1967 | Trudeau | 333/260 X |
| 3,970,969 | 7/1976 | Sirel et al. | 333/12 |

FOREIGN PATENT DOCUMENTS

| | | | |
|---|---|---|---|
| 114501 | 7/1983 | Japan | 333/246 |

*Primary Examiner*—Eugene R. LaRoche
*Assistant Examiner*—Benny T. Lee
*Attorney, Agent, or Firm*—Joseph P. Krause

[57] ABSTRACT

A transmission line using superconductors instead of conventional conductors substantially reduces ohmic losses compared to conventional conductors. The superconductors are cooled by refrigerant flowing through a hollow superconducting inner conductor. The refrigerant is transported to the inner conductor using a novel connector.

6 Claims, 2 Drawing Sheets

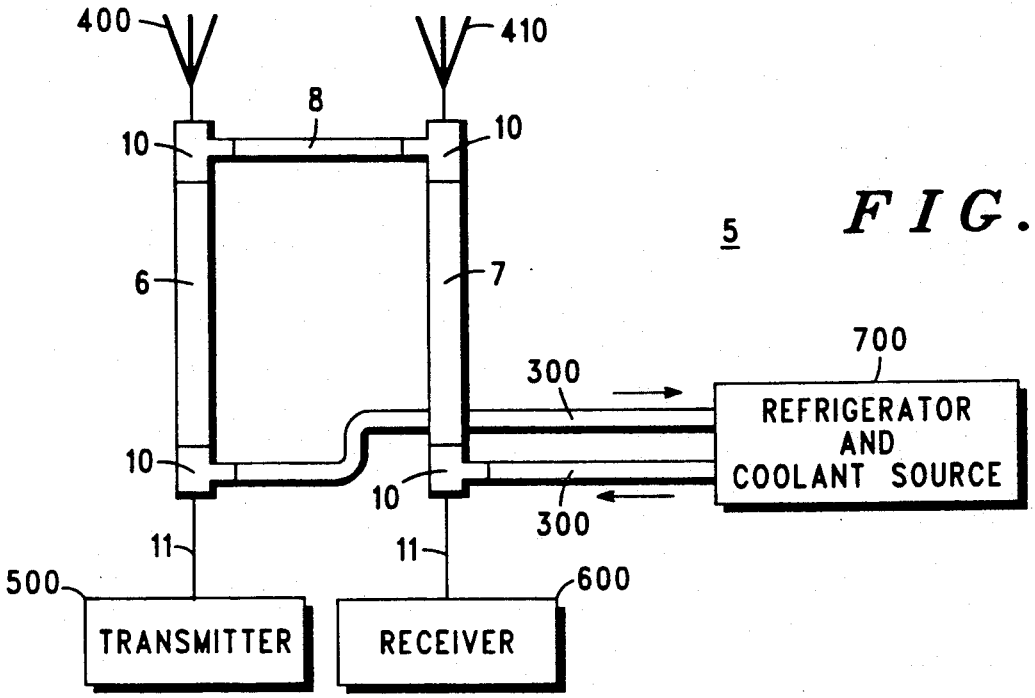
FIG.1
FIG.1A
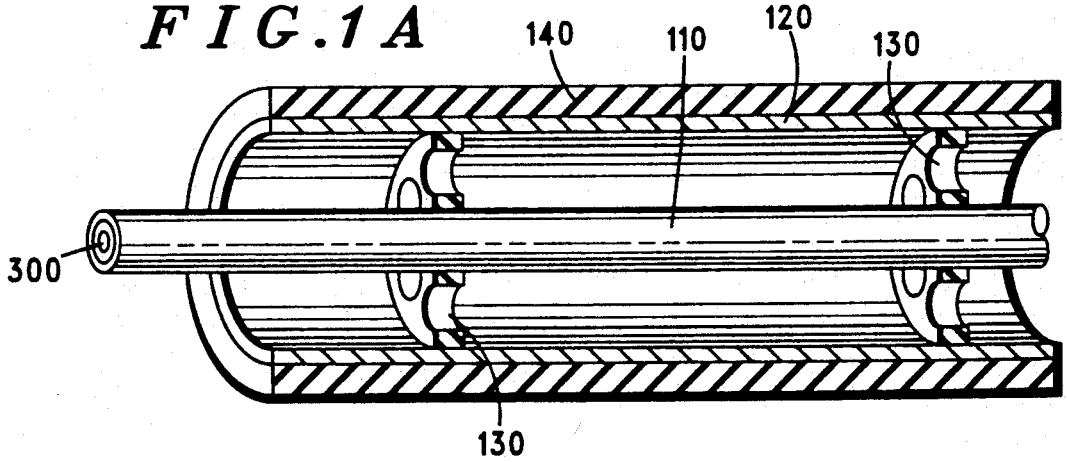

SUPERCONDUCTING TRANSMISSION LINE CABLE CONNECTOR PROVIDING CAPACATIVE AND THERMAL ISOLATION

BACKGROUND OF THE INVENTION

This is a continuation-in-part of application Ser. No. 07/372,504, filed Jun. 28, 1989, now abandoned.

This invention relates to transmission lines. In particular, this invention relates to low-loss transmission lines and cable connectors used with these transmission lines.

Coaxial cable transmission lines attenuate signals by both resistive and dielectric losses, and the attenuation increases as the frequency of a signal in the cable increases and as the physical size of the cable decreases. The most significant power loss in a modern transmission line carrying high frequency signals, however, is from ohmic loss attributable to power dissipation in the metallic conductors of the cable. At frequencies near 700 MHz, for example, the RF copper loss in conventional one and five-eighths inch (1⅝") cable can exceed 8 to 9 decibels per one thousand feet of cable. At frequencies near 800 Mhz copper losses of approximately 10 db per thousand feet are observed. Reducing the copper or ohmic loss in a coaxial cable would improve the performance of communication systems using transmitters and receivers remotely located from antennas.

It is now feasible to construct a coaxial cable transmission line using new, high-temperature superconducting materials. While these materials superconduct at the relatively high temperature of liquid nitrogen, as compared to early superconductors which superconducted at liquid helium temperatures, they must still be maintained at low temperatures to superconduct (approximately −270 degrees Centigrade). Superconductors in a coaxial cable transmission line must be reliably maintained at a low temperature and must be thermally isolated from warm surfaces. The superconducting cables must also be electrically and mechanically coupled to warm, non-superconducting materials, such as the antenna or communications equipment or other sections of cable to be able to transport signals between an antenna and communications equipment. A transmission line system that is able to employ superconductors in cables while retaining the ability to thermally isolate these materials from relatively warm components would be an improvement over prior art transmission lines.

SUMMARY OF THE INVENTION

There is provided herein a coaxial cable transmission line constructed of hollow, superconducting inner conductors and optionally a superconducting outer conductor. The center conductor transports a refrigerant, such as liquid nitrogen, to cool the center conductor directly while indirectly cooling the outer conductor which may also be a superconductor. A transmission line system using such cable may be constructed to two separate superconducting transmission lines wherein refrigerant is continuously cycled in one direction through the inner conductor of a first cable and in an opposite direction in the inner conductor of a second cable, thereby forming a loop. Alternate embodiments would include a single transmission line where refrigerant is cycled using a return line instead of a second cable or transmission line. Another embodiment would include sending the coolant through the center conductor in one direction and returning the coolant to the refrigerator using the space between the center conductor and outer conductor. Special connectors that thermally isolate the superconductors from normal conductors permit cooling fluid to enter and exit the center conductors. These connectors mechanically and electrically couple the superconducting cable to non-superconducting cable, antenna connections or other communications equipment.

A cable connector disclosed herein electrically and mechanically couples the superconducting cables and thermally isolates these superconducting cables from other non-superconducting cables and equipment. The connector uses dual coupling capacitors formed between the inner and outer conductors of the two cables at predetermined locations. The capacitors couple signals between the cables while mechanically connecting the cables and thermally isolating the superconductors. Predetermined placement of the coupling capacitors insures that a constant impedance looking into both ends of the connector is maintained. A port in the connector permits cooling fluid to flow into the inner conductor of the superconductor.

BRIEF DESCRIPTION OF THE DRAWINGS

FIG. 1 shows a superconducting transmission line system that connects a receiver and a transmitter to respective antennas.

FIG. 1A shows a section of the transmission line of FIG. 1.

DETAILED DESCRIPTION OF THE PREFERRED EMBODIMENT

Figure 2:
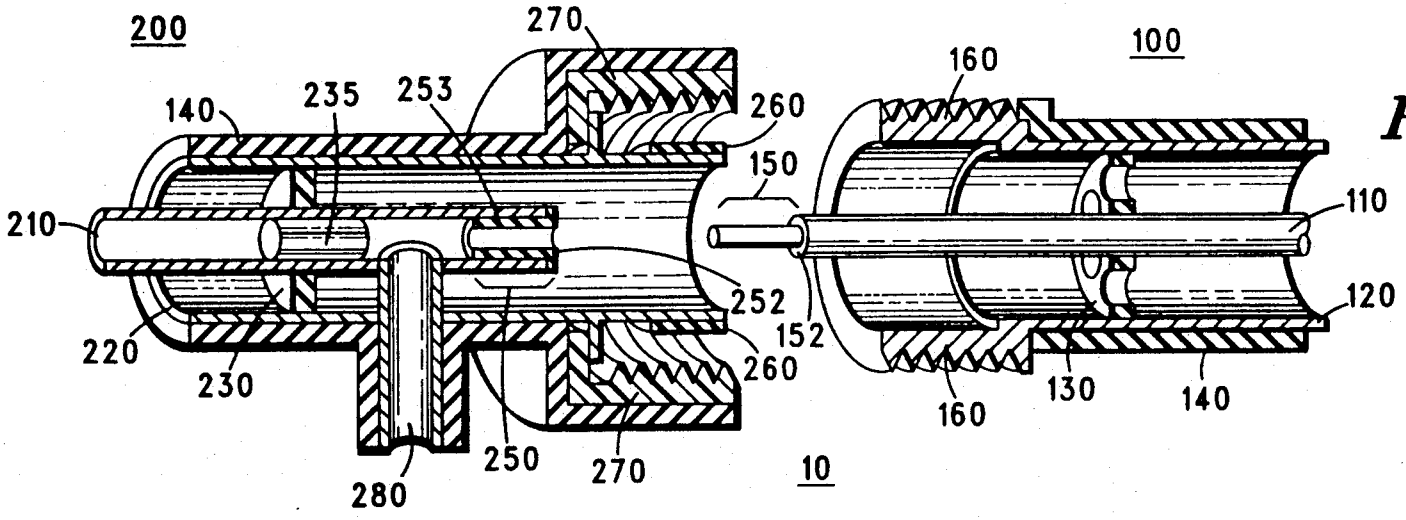
FIG. 2 shows a connector used in the transmission line system of FIG. 1 that permits refrigerant to flow through the center conductor.

FIG. 1 shows a superconducting transmission line system (5) comprised of separate superconducting transmission lines (6 and 7) the detailed construction of which is shown in FIG. 1A. Each of these superconducting transmission lines (6 and 7) is comprised of inner and outer conductors (110 and 120 respectively, shown in FIG. 1A) cooled by a refrigerant, which for the new high-temperature superconductors could be liquid nitrogen (300), flowing through the inner conductor (110). The inner conductor would normally always be a superconductor; the outer conductor may also be comprised of a superconductor. The superconducting inner conductor (110) could be a hollow superconductor or a hollow pipe coated with a superconductor material. If the outer conductor is to be a superconductor, it may be a hollow superconductor or a hollow pipe coated on its interior with superconductor material. Each superconducting transmission line (6 and 7) is coupled to superconducting coaxial cable connectors (10). The superconducting coaxial cable connectors (10) permit the refrigerant (300) to enter the center conductor (110) of each cable (6 and 7), cool the superconductor, exit the center conductor (110) through ports (element 280, which is shown in FIG. 2) in the connector (10), and thermally isolate the superconductor from the relatively high-temperature non-superconducting components e.g. the antennas (400 and 410) and high temperature cable (11).

A refrigerator and coolant source (700) circulates the refrigerant (300) around the transmission line system (5). As the refrigerant passes through the refrigerator and coolant source (700) excess heat absorbed from the transmission line system (5) is removed from the liquid nitrogen. Any nitrogen lost from the system may also be replaced.

Each transmission line (6 and 7) supports an antenna (400 and 410) which is coupled by the transmission lines to a transmitter (500) and a receiver (600).

The circulation of the refrigerant in two transmission lines as shown in FIG. 1 maximizes the usage of the circulating refrigerant (300). After the coolant (300) ascends (or descends) the first transmission line (6) it is rerouted by a connecting pipe (8) to the second transmission line (7) where it cools the second line rather than being routed back to the refrigerator and coolant source (700). An alternate embodiment might include merely returning the coolant (300) to the refrigerator and coolant source (700) at the end of a single transmission line (6 or 7).

The superconducting transmission lines shown (6 and 7) are constructed of superconducting inner and outer conductors (110 and 120 and shown in detail in FIG. 1A) thermally isolated from normal, non-superconducting materials at relatively high temperatures by the superconducting cable connectors (10). (Note that the outer conductor (120) is wrapped in an insulation layer (140) to reduce heat absorption.) The space between the center conductor (110) and the outer conductor (120) is maintained by means of spacers (130) distributed along the length of transmission lines (6 and 7). The spacers (130) may be constructed to permit a fluid to flow along the length of the cable in the space between the center conductor and the outer conductor. Alternate embodiments of the invention would include circulating a refrigerant in the space between the inner and outer conductors and adjusting the size of these conductors to obtain a desired impedance.

FIG. 2 shows the superconducting coaxial cable connector (10) used in the transmission line system of FIG. 1. The cable connector (10) is comprised of two halves (100 and 200) that, when coupled together and used with superconducting coaxial cable, mechanically and electrically couple the coaxial cables while thermally isolating low-temperature superconductors from relatively high-temperature normal cable. The connector (10) could also be used to couple two superconducting cables together. The two halves of the connector typically attach to the ends of the superconducting inner and outer conductors in a manner similar to the attachment of conventional coaxial cable connectors to conventional cable. The connectors also allow coolant to flow into the hollow center conductor (110) of the superconducting coaxial cable from an external source, such as the refrigerator and coolant source (700).

When the connector (10) shown in FIG. 2 is used with a normal, relatively high temperature, non-superconducting cable and the low temperatures of a high-temperature superconductor, the first half (100) of the connector (10) shown in FIG. 2 might be considered the half of the connector (10) that is coupled to a superconducting coaxial cable. The second half (200) of the connector (10) might be considered the half of the connector (10) that might be coupled to a relatively high temperature cable. Referring to FIG. 1, the second half (200) of the connector (10) would typically be used to couple the antennas (400 or 410) to the superconducting transmission lines (6 and 7) through the first, superconducting half (100) of the connector (10). Alternatively, the second half, (200) of the connector (10) might be used to couple the transmitter (500) or the reciever (600) to the transmission lines (6 and 7) through the first half (100) of the connector (10). Coupling of signals between these high temperature cables, i.e. antennas (400 and 410) or the transmitter (500) or receiver (600) is accomplished through a capacitive junction existing between the first half (100) and the second half (200) of the connector (10). These capacitive couplings permit the electrical coupling, thermal isolation and mechanical coupling between the relatively low temperature superconducting cables (6 and 7) and the relatively high temperature (or normal) cables and devices, such as the transmitter (500) and receiver (600), antennas (400 and 410). (A connection point for the center conductor high temperature portion (200) of the connector (10) might be the segment of the center conductor shown as 210. A plug (235) would block coolant flow through the center conductor. A connection point for the high temperature portion (200) of the outer conductor might be segment shown as 220.)

Figure 3:
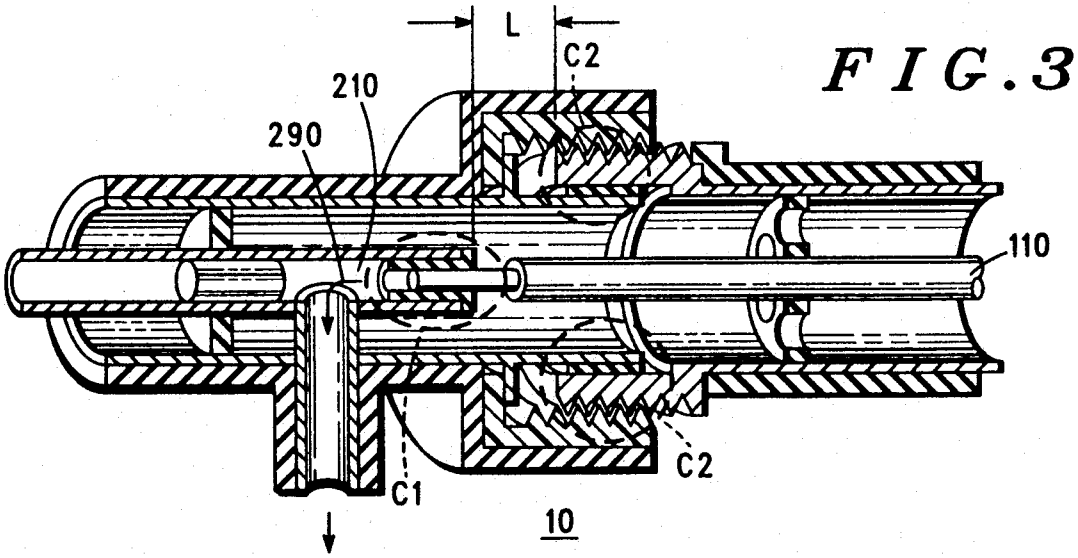
FIG. 3 shows the connector of FIG. 2 assembled.

The coupling and thermal isolation performed by the connector is accomplished by two capacitors (C1 and C2 shown in FIG. 3) coupling the inner and outer conductors of the superconducting cable (110) to the non-superconducting cable (210). The capacitive coupling also mechanically joins the two cables and seals the inner and outer conductors. The capacitor C1 is formed by filling with a dielectric material (such as ceramic, plastic etc.) the hollow region formed between the outer diameter of the region 150 of the inner conductor (110) and the inner diameter of the region 250 of the inner conductor (210) of the second half (200) of the connector. As shown in FIGS. 2 and 3, the region 150 of the inner conductor 110 has an outer diameter less than the inner diameter of the region 250 of the inner conductor 210. The capacitor C2 is formed by filling with dielectric the volume between the outer conductor 120 of the first half and the outer conductor 220 of the second half. The outer conductor (220) of the second half (200) has an outer diameter less than the inner diameter of the outer conductor (120) of the first half (100).

Two coupling capacitors (C1 and C2, which are shown in FIG. 3) that join the cables are formed by sections of the inner and outer conductors of the superconductor (110 and 120) that mate with corresponding sections of the inner and outer conductors of the non-superconductor cable (210 and 220 respectively). When the connector halves (100 and 200 shown in FIG. 2) are assembled together, the center conductor (110) of the superconductor half of the connector (100) fits within the center conductor (210) of the non-superconducting half (200) of the connector separated by a dielectric (253). The outer conductor of the non-superconducting half (220 shown in FIG. 2) fits within a dielectric (260 as shown in FIG. 2) that surrounds the outer conductor (220) of the non-superconducting cable half of the connector. (It should be obvious to one skilled in the art that reversing the relative sizes of the mating conductors would accomplish the same result. For example, the inner conductor (110) of the superconducting half (100) of the connector (10) could surround the non-superconducting inner conductor (210) of the non-superconducting half (200) of the connector (10) rather than fitting within the non-superconductor's inner conductor as shown in FIGS. 2 and 3. It should also be noted that both halves of the connector (10) could be superconducting.)

In addition to the capacitive coupling of the two halves of the connector (200 and 100), the dielectrics (253 and 260) mechanically seal the inner and outer conductors of the cables and thermally isolate the two conductors, permitting the superconducting cable to remain below its critical temperature.

As shown in FIG. 1A, the inner conductors of the cable of the transmission line (6 or 7) carry coolant for the superconductors. Of necessity, the center conductors (110 and part of 210, as shown in FIG. 2) of the connector (10) are hollow to permit cooling fluid to flow through the interior of the inner conductor of the cables (6 and 7). As shown in FIG. 2, one end (150) of the superconducting cable in the connector (10) includes a shoulder (152) that mates to a corresponding edge (252) of the dielectric of the connector fitting (250) inside the non-superconducting portion (200) of the connector (10) to insure that coolant is not lost in the fitting.

Circulation of coolant through the connector (10) is by means of an outlet tube (280) in the non-superconducting section of the connector (200). The outlet tube (280) permits the coolant flowing through the center conductors (110 and 210) to exit the connector (10) as shown by arrow 290 in FIG. 3. The outlet tube (280) in the preferred embodiment is also dielectric and is removed from the region of the capacitors (C1 and C2) to avoid any adverse coupling to these capacitors.

Coolant flowing through the center conductors (110 and 210) is prevented from flowing up into the non-superconducting cable by means of spacers (230) and a seal (235) on the inside of the inner conductor of the non-superconducting cable (see FIG. 2). The non-superconducting cable could alternatively be a solid rod, which would block the flow of coolant through the hollow center conductor of the superconductor, with only the end region hollowed out to accommodate the flow of refrigerant. The spacers used in the superconducting cable (130) could be porous to permit fluid to flow along the cable in the space between the superconducting inner and outer conductors, should this embodiment be chosen.

The coupling capacitors (C1 and C2, as shown in FIG. 3) are placed a predetermined distance apart (determined by the wavelength of the signal propagating along the transmission line) so that the reactive disturbance to the impedance of the transmission line by the first capacitor (C1) is cancelled by the second capacitor (C2) of the pair of coupling capacitors. The inner conductor coupling capacitor (C1) and the outer conductor coupling capacitor (C2) are placed approximately one quarter wave length apart (based upon the wavelength of the frequency near the center of the signal propagating along the cable). This insures that the impedance looking into both ends of the connector is very nearly maintained at the characteristic impedance of the transmission line. Alternate embodiments would include separating the coupling capacitors by integer multiples of a one-quarter wavelength so that the reactances of the two capacitors cancel. Separating the capacitors ¼ wavelength allows the effect of the reactances of the two capacitors to cancel each other.

The capacitive coupling scheme used in the connector (10), where the capacitors are formed by the inner and outer conductors and spaced approximately one-quarter wavelength apart, avoids a direct contact between the superconductor's low temperature surfaces and high temperature bodies permitting the superconductor to remain below its critical temperature while allowing signal propagation at a relatively constant impedance.

A third dielectric (270) shown between the outer layer of the superconductor (160) but within the insulation layer (140) envelopes the entire connector assemblies. This dielectric (270) can assist in forming a seal by the outer conductor (160) and improve the mechanical strength of the joint and maintain thermal isolation between the outer conductors (120 and 220).

FIG. 3 shows the connector of FIG. 2 assembled. The coupling capacitors (C1 and C2) are shown spaced by a predetermined distance L that should be substantially equal to one quarter of the wave length of a signal propagating through the coaxial cables. The one quarter wave length spacing of the capacitors is essential to maintain a uniform impedance from the input to the output of the connector. Since the connector shown in FIGS. 2 and 3 is contemplated to be used with a coaxial cable, which has a well-known geometry, placement of the capacitors with respect to each other, i.e. being separated by a distance substantially equal to one-quarter of a wave-length of a signal propagating through the cable, requires placement of the two capacitors separated from each other along the axis of the cable. (The axis of the cable is considered to be substantially coincident with the center conductor.) Stated alternatively, the first capacitor $C_1$ might be placed in the connector as shown in FIG. 3 whereas the second capacitor $C_2$ would be located along the length of the cable a distance L, as shown.

In the preferred embodiment both inner and outer connectors were superconducting in the superconducting coaxial cable. Liquid nitrogen was pumped to the inner conductor which directly cooled it and cooled the outer conductor by convection. The coupling capacitors of the conductor must of course be substantially of equal value to properly maintain a uniform input-to-output characteristic impedance.

The materials used for the superconducting elements of the coaxial cables (6 and 7) and superconducting components of the connector (10) would include yttrium-barium-copper-oxide, known in the art as YBCO. Other materials would of course include niobium-based materials or other superconducting materials.

Those skilled in the art will recognize that the connector (10) shown in FIGS. 2 and 3 would be well adapted to couple a relatively high-temperature superconducting cable (shown as item 11 in FIG. 1) to the superconducting cables (6 and 7). In such applications, cables 6 and 7 might be coupled to the supreconducting half (200) of the connector (10) and would typically be substantially longer that the non-superconducting cable (11) to minimize ohmic power loss between the tranmsmitter (500) and receiver (600) and the antennas (400 and 410).

What is claimed is:

1. A connector, electrically and mechanically coupling and thermally isolating a first high-temperature coaxial cable from a second low temperature coaxial cable, said first high-temperature coaxial cable having at least inner and outer conductors and being a nonsuperconducting cable and said second low temperature coaxial cable having at least inner and outer conductors, at least one of said inner and outer conductors of said second cable being superconductors that require thermal isolation from relatively high temperature bodies, said connector comprising:

first connector half having a hollow outer conductor with a first inner diameter and having at least a hollow superconducting center conductor, a portion of said superconducting center conductor having a second predetermined outer diameter dimension and having a third inner diameter dimension, said center conductor of said first connector half being capable of conducting refrigerant there through, said center conductor of said first connector half being coupled to the inner conductor of said second low temperature coaxial cable and said outer conductor of said first conductor half being coupled to the outer conductor of said second low temperature coaxial cable;

second connector half having a hollow outer conductor having a first outer diameter less than said first inner diameter of said outer conductor of said first connector half, and having a center conductor at least a predetermined length of which is hollow, said hollow length with a predetermined inner diameter greater than the outer diameter of said superconducting center conductor of said first connector half and having an exit port means extending from said hollow portion of said center conductor through the outer conductor of said second connector half, said exit port means for conducting refrigerant from said hollow superconducting center conductor of said first connector half when said first and second connector halves are joined together, said center conductor of said second connector half being coupled to the inner conductor of said first high-temperature coaxial cable and said outer conductor of said second conductor half being coupled to the outer conductor of said first high-temperature coaxial cable;

first capacitive coupling means for mechanically and capacitively coupling and thermally isolating the inner conductors of said first and second cables, said first capacitive coupling means being a dielectirc occupying a volume defined between the outer diameter of said center conductor of said first connector half and the inner diameter of said center conductor of said second connector half;

second capacitive coupling means for mechanically and capacitively coupling and thermally isolating the outer conductors of said first and second cables, said second capacitive coupling means being a dielectric occupying a volume between the outer diameter of said outer conductor of said second connector half and the inner diameter of said outer conductor of said first connector half said second capacitive coupling means displaced from the first capacitive coupling means by a distance approximately equal to an integral number of one-quarter wave lengths of a signal propagating through said coaxial cables.

2. The connector of claim 1 where said outer connector of said first cable is a superconductor.

3. The connector of claim 1 where said first and second capacitive coupling means include first and second dielectic means for sealing, and thermally isolating said inner and outer conductors of said first and second cables.

4. The connector of claim 3 where said inner conductors of said first and second coaxial cables are hollow.

5. The connector of claim 4 where said hollow inner conductors of said first and second coaxial cables transport said refrigerant.

6. The connector of claim 1 where said inner conductor of at least said first cable is a superconductor.

* * * * *